United States Patent [19]

Nichols, Jr.

[11] Patent Number: 4,622,042

[45] Date of Patent: Nov. 11, 1986

[54] TEXTILE DYEING PROCESS

[75] Inventor: David B. Nichols, Jr., Dalton, Ga.

[73] Assignee: RCA Corporation, Princeton, N.J.

[21] Appl. No.: 916,901

[22] Filed: Jun. 19, 1978

[51] Int. Cl.[4] ..... D06P 5/00

[52] U.S. Cl. ..... 8/478; 8/485; 8/680; 8/924; 8/929

[58] Field of Search ..... 8/1 XB, 14, 15, 25, 8/478, 485

[56] References Cited

U.S. PATENT DOCUMENTS

| | | | |
|---|---|---|---|
| 545,420 | 8/1895 | Bamford | 8/1 XB |
| 617,772 | 1/1800 | Rettig | 8/14 |
| 790,817 | 5/1905 | Bucher | 8/14 |
| 1,210,279 | 12/1916 | Diener | 8/14 |
| 1,579,872 | 4/1926 | Lecjaky | 8/14 |
| 1,754,287 | 4/1930 | Shoemaker | 8/14 |
| 2,002,848 | 5/1935 | Cohen | 91/68 |
| 2,090,890 | 8/1937 | Howard et al. | 8/5 |
| 2,313,726 | 3/1943 | Atwell | 260/20 |
| 2,321,974 | 6/1943 | Bird | 8/14 |
| 2,359,776 | 10/1944 | Milne et al. | 8/65 |
| 3,220,793 | 11/1965 | Parsons et al. | 8/14 |
| 3,414,369 | 12/1968 | Kitamura et al. | 8/64 |
| 3,468,694 | 9/1969 | Moritz et al. | 8/15 |
| 3,669,611 | 6/1972 | Shimauchi et al. | 8/14 |
| 3,756,770 | 9/1973 | Kahayushi et al. | 8/14 |
| 3,945,791 | 2/1976 | Buhrn | 8/14 |
| 3,963,428 | 6/1976 | Stark | 8/1 XB |
| 4,000,964 | 1/1977 | Newton | 8/14 |
| 4,010,709 | 3/1977 | Sayman et al. | 118/33 |
| 4,127,014 | 11/1978 | Miller et al. | 68/13 R |
| 4,146,362 | 3/1979 | Nichols | 8/485 |
| 4,189,302 | 2/1980 | Toland | 8/14 |

FOREIGN PATENT DOCUMENTS

| | | | |
|---|---|---|---|
| 763022 | 7/1971 | Belgium | 8/1 XB |
| 2147972 | 3/1973 | Fed. Rep. of Germany | 8/14 |
| 2148871 | 5/1973 | Fed. Rep. of Germany | 8/62 |
| 4540716 | 12/1977 | Japan | 8/14 |
| 490532 | 8/1938 | United Kingdom | 8/65 |
| 740291 | 11/1955 | United Kingdom | 8/65 |
| 1243403 | 8/1971 | United Kingdom | 8/14 |
| 1363129 | 8/1974 | United Kingdom | 8/14 |

OTHER PUBLICATIONS

Dawson, Jour. of Soc. of Dyers & Colorists, vol. 90, pp. 235–238, Jul. 1974.

Wigfall, S. Textile Colorist, Apr. 1944, pp. 170–173.

Amer. Dyestuff Reporter (ADR) Jul. 23, 1951, p. 478.

ADR Jun. 1971, pp. 25–31, Leifeld, G.

German Publ. *Kusters* 1973.

Hall, A. The Standard Handbook of Textiles.

*Primary Examiner*—A. Lionel Clingman

*Attorney, Agent, or Firm*—Joseph S. Tripoli; George E. Haas; William Squire

[57] ABSTRACT

A continuous process for dyeing a tufted carpet includes the step of dyeing the entire carpet, in one dye color, with a first, relatively low viscosity dye. The carpet is then vibrated to cause the tufts to stand up. The entire tufted surface of the carpet is then coated with a relatively viscous second dye. Drops of a third dye, which is less viscous than the second dye and substantially more viscous than the first dye are then applied over the more viscous second dye coated tufts. A fourth dye which is substantially less viscous than the second and third dyes is then applied over the entire tufted surface of the carpet.

15 Claims, 3 Drawing Figures

TEXTILE DYEING PROCESS

The present invention relates to a continuous process for dyeing textiles which is particularly suitable for carpeting.

Of interest are U.S. patent application Ser. No. 757,371, filed June 22, 1985, entitled "Textile Dyeing Process for Multicolor Nylon Carpet," by David Banks Nichols, Jr. (allowed), which is a continuation of U.S. patent application Ser. No. 916,900, filed June 19, 1978, entitled "Textile Dyeing Process" (abandoned); U.S. patent application Ser. No. 916,903, filed June 19, 1978, entitled "Textile Dyeing Process," by David Banks Nichols, Jr.; U.S. patent application Ser. No. 916,889, filed June 19, 1978, entitled "Textile Dyeing Process, " by David Banks Nichols, Jr.; and U.S. patent application Ser. No. 916,893, filed June, 19, 1978, entitled "Textile Dyeing Process," by David Banks Nichols, Jr., all of the above being assigned to the assignee of the present invention.

TAK dyeing, which is a relatively recent development in the carpet industry, is a continuous dyeing process in which dye is deposited, in drops, on the tufted side of the carpet. A wide variety of dye colors may be employed and different random color patterns obtained. Typical apparatuses which may be used for applying the dyes in drops are disclosed, for example, in U.S. Pat. Nos. 3,683,649; 3,800,568; 3,726,503; 3,964,860; and 4,010,709.

The ever changing tastes of the public places a continuous demand on the carpet industry for new styles which are both pleasing and attractive. In my copending application Ser. No. 661,396, filed Feb. 25, 1976, now abandoned I describe a method and apparatus, now in wide use, for producing one group of such styles. In this method, a layer of a liquid, such as a water soluble gum, is applied to the tufted surface of the carpeting and then drops of dye(s) are applied to the gum wetted tufts. The dye or dyes spread, blend, attenuate and provide in the finished product, randomly varying patterns with gentle shading effects, which are pleasing to the eye.

I describe a second dyeing technique in my copending application Ser. No. 851,418, filed Nov. 14, 1977 now U.S. Pat. No. 4,146,362. Here a relatively viscous first dye is deposited, for example, in drops onto spaced regions of a textile and a less viscous second dye is then deposited onto regions of the textile which include the spaced regions. The first dye colors the regions of the textile it reaches in the first dye color and masks these regions from the second dye. The second dye colors the regions of the textile it reaches in the second dye color and does not substantially affect the regions of the carpet masked by the first dye. This process provides additional new and pleasing coloring effects; however, the market continually demands other pleasing styles.

In a process embodying the invention for dyeing a textile, a relatively viscous first dye is deposited over a first regions of the material. A second dye less viscous than the first dye is then deposited over spaced regions of the material wetted with the first dye and a third dye substantially less viscous than either the first or second dyes is applied to regions which include the first and spaced regions.

Figure 1:
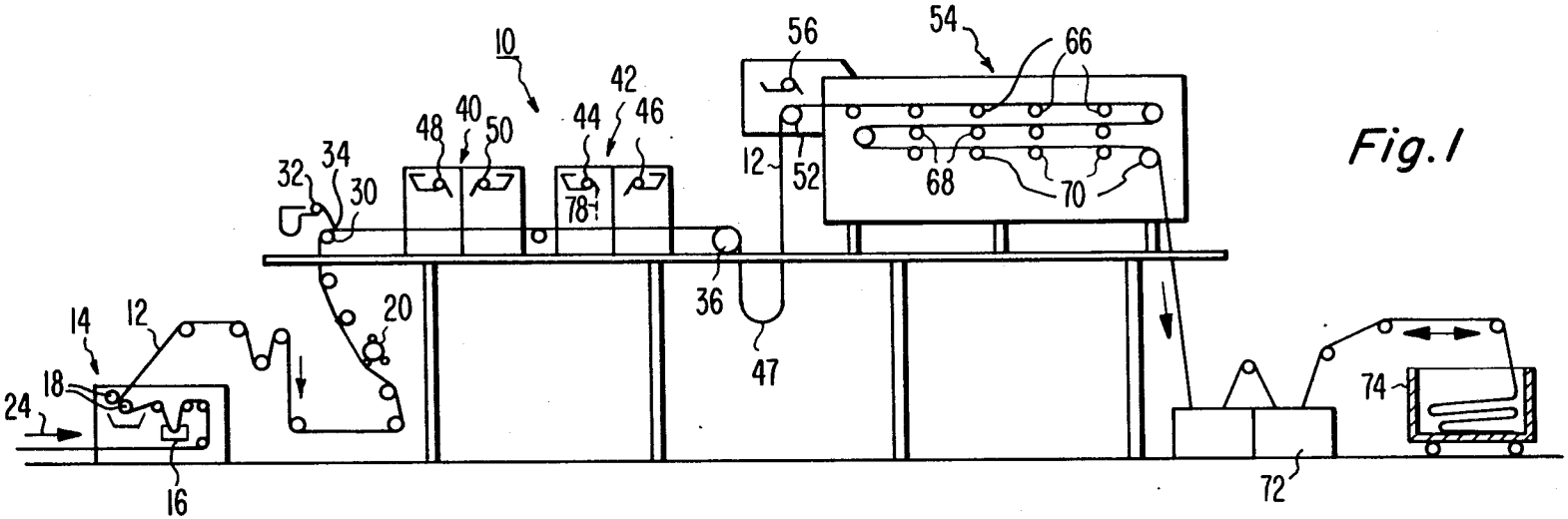
FIG. 1 is a schematic side elevational of a carpet dyeing apparatus used to practice a process embodying the present invention.

The apparatus shown in FIG. 1, is particularly suitable for dyeing carpeting but may be used on woven or flocked material that has some pile height. For example, a pile height of at least ¼ inch would be desirable. The carpeting is fed from a supply roll (not shown) through a pad machine 14. The latter includes a reservoir 16 containing a low viscosity dye through which the carpet passes. The carpet is then conveyed through two squeeze rollers 18 which remove sufficient dye from the carpet tufts to provide a desired percent of liquid "pick-up" in the carpet. The expression "percent pick-up" is a measure of weight of the liquid in a given area of the carpet and in particular is the ratio of the weight of the liquid in the given area of the carpet to the dry weight of that same area of the carpet, multiplied by 100. In one particular form of the invention, the low viscosity dye in the reservoir 16 is at room temperature and has a viscosity of about 50 centipoise (CPS) and a pH of about 4. This viscosity may have a value in the range of 15 to 50 CPS. The pH may be in the range of 2 to 4.

Figure 2:
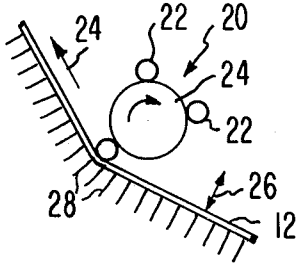
FIGS. 2 and 3 are sectional, partially schematic side elevational views of portions of the apparatus of FIG. 1.

The carpeting 12 is then fed by a plurality of guide rollers past a beater 20 shown in greater detail in FIG. 2. The beater comprises a central roller 24 extending the entire breadth of the carpeting and a plurality of elongated pipes 22 extending in the axial direction of the roller and secured to its surface.

In operation, the beater 20 is rotated at high speed so that the pipes 22 strike the backing of the carpet as the carpet is moved in the direction 25. This action causes the carpeting to vibrate in the directions 26 and the vibration causes the wetted tufts 28 to "stand up" (to extend generally at right angles from the backing).

The carpet web then advances upwardly and around roller 30, FIG. 1 and past a viscous liquid applicator 32. An applicator of this type is described in detail in my copending application Ser. No. 661,396, filed Feb. 25, 1976. In the present process the applicator 32 applies a sheet of viscous dye (which includes a substantial percentage of gum-examples given later) to the tufted face of the carpet over the entire width of the carpet web. The carpet is oriented horizontally at this point. The web of carpeting is then pulled horizontally over guide rollers by drive roller 36 through machines 40 and 42.

Figure 6:
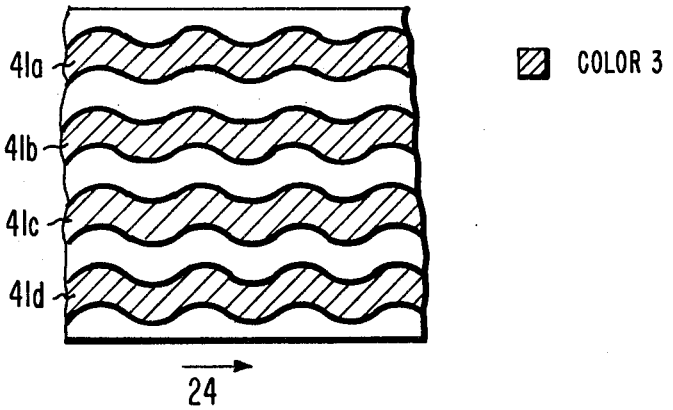
FIG. 6 illustrates some of the patterns produced by portions of the apparatus of FIG. 1.

Machine 40 comprises two identical, separate drop dispensing applicators 48 and 50 which are opposite and facing each other. Machine 42 also comprises two separate and independent identical drop dispensing applicators 44 and 46. Machine 42 has the capability of dispensing drops (or streams) of a liquid in a zig-zag pattern over spaced areas and is sometimes referred to as a multi-TAK machine. For purposes of the following discussion "drops" will be referred to by way of example but it is to be understood that this is intended to be generic to drops, streams and so on. Applicator 44 applies patterns 41*a–d* (FIG. 6) and applicator 56 can apply similar patterns over regions of the carpet different than patterns 41*a–d*. In FIGS. 1 and 6, the direction of the carpet movement is as indicated by arrow 24.

The machine 40, on the other hand, is capable of dispensing drops (or streams) of liquid randomly over the entire tufted face of the carpet and is referred to as a TAK machine. A machine similar to machine 42 is illustrated in U.S. Pat. No. 3,964,860 and a machine similar to machine 40 is described in U.S. Pat. No. 4,010,709.

After leaving machine 42, the carpet material is conveyed downward into a tension compensating loop 47 and then upward to an elevation above the level of the carpeting 12 in the machines 40 and 42, to roller 52. The web of carpeting traverses around roller 52 beneath dye applicator 56. The latter, which is of conventional construction, is sometimes known as a Kusters applicator. Dye applicator 56 applies a continuous sheet or layer of dye to the tufted surface of the carpeting, over the entire width of the carpeting. In the application region, the carpeting is horizontally oriented.

Figure 3:
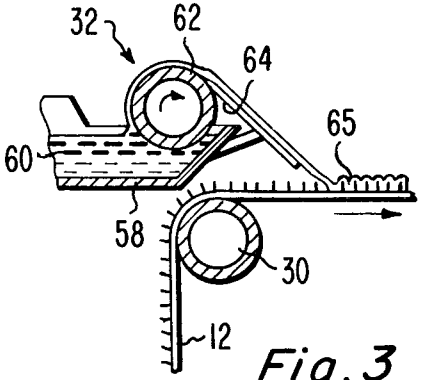

FIG. 3 illustrates a portion of the dye applicator 56. It includes, a pan 58 for receiving a dye reservoir 60 and a roller 52. The roller picks up a layer of the dye from reservoir 60 and this layer is brought into contact with the edge of doctor blade 64. The latter peels a sheet 65 of the dye away from the roller and delivers it to the tufted surface of the carpet. The dye applicator 32 includes similar structure; however, a special set of input ports is employed to insure that the viscous dye dispensed by applicator 32 will be of uniform height. The operation of applicator 32 is similar to the operation of the applicator disclosed in my copending application No. 661,396.

The carpet enters the steamer 54 after it passes the dye applicator 56. The steamer includes a first set of rollers 66 for transporting the carpet in a first horizontal pass in the steamer, a second set of rollers 68 for transporting the carpet in a second horizontal pass in the steamer, this one with the tufts pointing downward, and a third set of rollers 70 for transporting the carpet in a third horizontal pass in the steamer.

The carpet exits the steamer in a substantially downward direction and passes into a washing apparatus 72. The latter has two compartments for washing the carpet and for removing unfixed dye and chemicals from the carpet. The dye viscosity of the second dye applied by applicator 32 is lowered in the steamer as a result of being heated and any excess is readily removed in the washing apparatus. Any other remaining excess elements also are readily removed. The washed carpet passes into a suitable container 74 and is later transported to and dried by a drying machine (not shown).

In carrying out the present process, reservoir 16 in the pad machine 14 is filled with a low viscosity dye, call it color 1. This dye is a mixture of dye chemicals in the desired proportion to obtain a given color, water at room temperature, a wetting agent, acetic acid, a fabric softener, a water softener, a vegetable gum and a defoamer having a mixed viscosity of 50 CPS and a pH of about 4. A dye with a low pH is employed as it becomes fixed rapidly in the steamer. A low viscosity is employed so that the dye tufts will still be susceptable to coloring by later applied dyes. In particular, it is desired that the tufts be able to accept another low viscosity dye applied later in the process by applicator 56. The pad dyeing by machine 14 fills in and colors those tuft portions of the carpet not dyed by the later applied color 2 dye, as will be described. For this reason, color 1 generally is chosen to be a lighter shade than color 2.

After leaving the pad machine 14, the carpet is squeezed to about 130–140 percent pick-up Sheet 34 of the relatively viscous color 2 dye is then applied to the tufted face of the carpeting. This dye preferably has a viscosity of about 1,800 CPS but may be within a range of 600 to 5,000 CPS. This sheet of dye may be about a quarter of an inch thick and is of uniform thickness when applied across the entire face of the carpet.

The color 2 dye is formulated from acetic and formic acids, water, a defoamer, a preservative, gum and dye chemicals to produce a relatively viscous dye liquid at a pH of about 3. This pH results in this dye fixing relatively quickly in the steamer 54, usually in the first pass while on rollers 66.

The color 2 dye applied to the carpet tends to sink into the spaces between the tufts and to coat varying portions of the tufts as will be discussed in detail later The depth to which this dye penetrates may vary at different parts of the carpet. In general, the viscosity of this dye is sufficiently high that it does not sink all of the way to the carpet backing although this may occur in isolated small regions.

In the present process, the machine 40 for applying drops of liquid is not in use and there is a relatively long distance between the applicator 32 and the first drop applicator 44. In one example that is in use, this distance is about 12 ½ feet. The carpet traverses this distance in about 25 seconds. A viscosity of 1,800 CPS is found, in practice, to provide an average depth of dye, color 2, penetration into the carpeting at the time of fixing of approximately 30 to 40 percent. This produces one kind of effect in the finished product. Lower dye viscosities permit deeper average dye penetration and higher dye viscosities shallower average penetration for different effects in the finished product for a given tufting density, lay of tufts, and time for penetration. The distance traveled affects the depth of dye penetration by affecting the time the dye is permitted to penetrate. The gum used in the color 2 dye to control its viscosity may be made from any suitable vegetable base of the type described in the aforementioned copending application No. 651,936.

Figure 4:
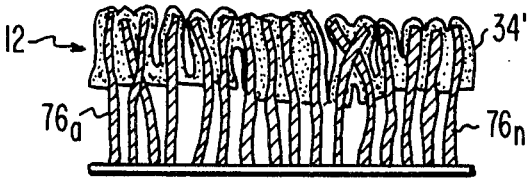
FIGS. 4 and 5 are fragmentary cross-sectional views taken through the carpet at different points in the process.

FIG. 4 shows a portion of the carpet 12 as it appears after leaving the dye applicator 32 and before it reaches the machine 42. The upstanding tufts *72a–76n* are fully colored by the color 1 dye applied by pad machine 14. The color 2 dye 34' applied by applicator 32 penetrates the spaces among the various tufts by varying amounts but, in general, coating the top 30–40% of the tufts. Most of the tufts are upright and the relatively viscous color 2 dye sinks to the 30–40% level as the carpet moves As color 2 is generally a deeper shade than color 1 and as it is more viscous than color 1, color 2, in general, dominates over color 1. That is, wherever the color 2 dye lands on a tuft, its shade appears, that color 2 shade simply covering and/or masking the color 1 shade which formerly colored the same portion of the tuft.

However, not all tufts are made to stand up by the beater 20. Those few and generally isolated tufts which remain bent over and compressed may be protected from color 2 by the other tufts which cover them. In the present process it is desired too that the upper 30–40 percent of all the tufts create a certain coloring effect. If one of the isolated tufts just described did not receive any color 2, and if that tuft were not dyed in color 1, it would be uncolored (white) at this point in the process, and this would be undesirable.

By "padding" the carpet with a color 1 dye which is a lighter shade of the color 2 dye, this undesired effect can be avoided. If a tuft is not colored at its tip by the color 2 dye, the tip will still be in color 1 which is a lighter shade of color 2. A protected tuft of this kind also may be protected (in whole or in part) by the overlying tufts from colors 3 and 4 applied later by applicators 44 and 56, respectively. However, the color 1 shade at the tuft tips still provides a pleasing effect in the final product of isolated highlights in one shade at the tuft tips in an overall deeper shade at the tuft tips and, as will be shown later, with other shading of the tips created by the color 3 dye and with the tuft bases in a different contrasting color.

The applicator 44 contains a third dye in a particular dye color, call it color 3. This dye may have a viscosity of about 600 CPS, in this example. This viscosity may have a value in the range of 600 to 1,200 CPS.

The dye formulation is conventional. Dyes suitable for use with nylon carpeting are preferably water soluble acid dyes. In general, the dye may be formulated by mixing a number of different primary color dyes to form the desired color shade. The dye is selected to be compatible with the particular synthetic, natural or mixtures of fibers in the particular tufts being dyed.

There are a number of factors which must be considered in choosing the viscosity of the color 3 dye. The viscosity must be sufficiently high that it masks those tufts or the portions of the tufts the color 3 dye reaches from the lower viscosity later Kusters applied color 4 dye (applied at 56). For a Kusters applied dye (color 4) at a viscosity of about 50, the color 3 dye should have a viscosity of at least about 600 CPS to carry out this function. The higher the viscosity of the color 3, the greater its shielding effect, for a given dye viscosity. The viscosity of the color 3 dye also should be sufficiently low so that the drops of the color 3 dye readily can penetrate into (and through) the sheet of the color 2 dye (applied at 32). For a color 2 dye viscosity of 1,800 CPS, the color 3 dye viscosity should not be higher than about 1,200 CPS. If the color 2 dye viscosity is greater than 1,800 CPS, then the color 3 dye viscosity can be greater than 1,200 CPS; similarly, if the color 4 dye viscosity is lower than 50 CPS, the color 3 dye viscosity can be lower than 600 CPS. The lower the viscosity of color 3 dye, the quicker the penetration of the color 3 dye through the color 2 dye, for a given color 2 dye. Different viscosities chosen for the color 3 dye will cause different dyeing effects, generally in subtle ways.

Applicator 44 dispenses color 3 dye in drops 78 (FIG. 1) and the drops 78 are confined to spaced areas 41*a–d*, respectively, shown in FIG. 6. In the particular design illustrated, the dye drops 78 produced by applicator 44, fall on regions 41*a–d* which are spaced from one another by intermediate regions which are not reached directly by the dye drops (although there may be some splashing).

Figure 5:
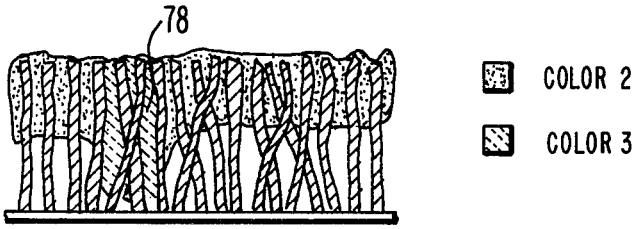

FIG. 5 shows a section of the carpet onto which a drop 78 of color 3 dye has fallen. Due to its relatively high viscosity and the force of gravity the drop has penetrated into and through the layer or coating of the color 2 dye. In general, the drop may remain in the dye 2 layer, or it may penetrate partially through the dye 2 layer, or it may actually reach the carpet backing. In the example of FIG. 5, the drop 78 has reached the carpet backing; however, the degree of penetration will depend upon such factors as the size and viscosity of the drops, the height from which the drops fall, the rate of application (number of drops, per second), the thickness of the dye 2 layer, and the other factors. The color 3 dye is relatively viscous but not as viscous as the color 2 dye (the color 3 dye may, for example, have a viscosity of 600 CPS compared to 1,800 CPS for the color 2 dye) and the former is able to displace the color 2 dye and to be absorbed by those tufts it comes in contact with.

Color 3 may be made a slightly lightar shade of color 2, so as to give highlight effects to upper ends of the tufts. The drops of the color 3 dye color the tip portions of the tufts they reach and spread and blend with restricted regions of the color 2 dyed tips. The drops of color 3 dye create sporadic lighter shades which randomly occur throughout the predominant color 2 shade of the portions of the tufts dyed by the color 2 dye. This gives a shimmering visual appearance. The general depth of penetration of the drops color 2 should be about 30–40 percent to give the desired effect. While greater depth of penetration may occur, it is not essential.

The reservoir of applicator 56 is filled with a fourth dye in another shade or color, call it color 4, which has a substantially lower viscosity than the color 2 and 3 dyes. For example, if color 3 dye has a viscosity of 600 CPS the color 4 dye may have a viscosity of from 30–60 CPS, but could vary from this somewhat to achieve its desired effect, as will be explained. This dye 4 has a pH of about 5. The color 4 dye viscosity should be about the same as the color 1 viscosity so that color 4 dye can readily penetrate in tufts saturated with color 1. The color 1 and color 4 dyes can have the same pH's but it is preferable that the color 1 be lower in value. Those tufts previously coated with colors 2 and 3 dyes are masked in the coated areas from color 4. Thus the color 4 dye mainly dyes the base areas of most tufts and its color predominates over the pad applied color 1 dye in these base regions. The tips of the tufts (30–40% or so) are protected from the color 4 dye by the more viscous color 2 dye. Some random tufts may be dyed completely by color 3 (and thus protected from the color 4 dye) if these random tufts were coated completely by color 3 drops.

There is also some coloring which takes place in the steamer itself. For example, on the first horizontal pass through the steamer, the low-viscosity color 4 dye becomes 90 percent or so fixed. On this pass, the viscosity of the color 4 dye is reduced because of the heat. On the second horizontal pass, the remainder of the less-viscous color 4 dye may run down that tuft to the tip of the tuft. In the example, the carpet traverses each pass somewhat more than one minute to achieve this affect. In those tufts which previously had their tips protected by the more viscous dyes some of the color 4 dye, attenuated in color, may now reach the tip of the tuft, mix with the previous dyes and become fixed there. This may provide a slight shading of the color 2 with color 4 at the tuft tips. This is barely perceptable in the finished carpet. As another effect in the steamer, some of the color 3 dye, sort of swimming in a viscous color 2 dye layer over an occasional bent over tuft, which color 3 dye has already colored to some extent, may color the tuft more strongly during the first horizontal pass in the steamer, in view of the reduced color 2 dye viscosity.

While particular drop applicators have been described, the manner of applying color 3 is not critical as long as it is applied in spaced regions of the carpet, rather than to all of the tufts.

The high viscosity dyes act as shields to the low viscosity color 4 dye and this color 4 dye may be applied over the color 1, 2 and 3 dyes in the manner described.

While the dyes disclosed herein are water soluble acid dyes, for use in nylon yarns, it should be understood that other yarn material, and also other types of dyes that are suitable for these other materials may be used instead.

Each of the dyes may be prepared and selected from available colors in the manner described in detail in the aforesaid copending application No. 851,418 filed Nov. 14, 1977. The pH of the colors 2 and 3 dyes used are acidic; they may have a pH of 3 or so, so that the dyes will fix relatively quickly in the steamer 54. This particular pH value is not critical and could vary but should remain within the acidic range. In one particular process, it is estimated that about 90–95 percent of the color 4 dye becomes fixed during the first horizontal pass of the carpet within the steamer 54 due to its relatively higher pH.

The following are specific examples of processes embodying the present invention:

EXAMPLE 1

The textile is a 12 foot wide carpet comprising backing material tufted with nylon yarn in a 12 foot width.

| Color 1, Pad Machine 14 | |
|---|---|
| 6.81 kg | "Progowet FS" a tradename of the Chemical Process of Georgia Company which is an ethoxylated alcohol |
| 3.25 kg | Acetic Acid |
| 6.25 kg | Syngum D47D manufactured by the Steinhall Company or General Mills |
| 11.35 kg | "Chemcoloft 75-N" a tradename of Chemical Processing of Georgia Company which is a fabric softener formed of a fatty imidazoline polyethylene emulsion. |
| 1.0 kg | "Quadafoam MA" which is a tradename for Quaker Chemical Corporation, North Carolina which is modified silicone base formed of silicone and chlorinated parafin used as a defoamer |
| 1.0 kg | H-100 a tradename of WACO Chemical Company Dalton, which is a chelating agent or water softener, comprising ethylene diamine tetra acetic acid (EDTA) |
| 0.51 kg | Acid Blue 140 |

The above ingredients are mixed with the tap water heated to room temperature to make a 5,000 lb. mixture having a pH of 4 and a viscosity of 50 CPS.

A premeasured tank is filled about half-way with the heated tap water. The gum is added and then mixed. The remaining chemicals are then added with the acid added last. Heated water at room temperature is then added to a Predetermined level to produce the desired 5,000 lb. mixture. This mixture is then mixed for about 2 hours. A similar procedure is followed for the dye mixtures described below. The dye is applied to the carpet in the pad applicator with 30 lbs. per square inch of roller pressure on the carpet providing 140 percent pick-up of the pre-wet solution.

| Color 2, Applicator 32 | |
|---|---|
| 0.41 kg | Acetic Acid |
| 8.16 kg | Formic Acid |
| 26.1 kg | Syngum D47D |
| 2.72 kg | Quadafoam MA |
| 11.7 kg | Acid Blue 40 |

-continued

| Color 2, Applicator 32 | |
|---|---|
| 2.72 kg | Dimethoxane, DXN, a preservative |

The above ingredients are mixed with sufficient tap water at room temperature to produce a 6,000 lb. mixture with a pH of 3 and a viscosity of 1,800 CPS.

| Color 3, Applicator 44 | |
|---|---|
| 2.72 kg | Progowet FS |
| 5.6 kg | Syngum D47D |
| 2.72 kg | Formic Acid |
| 0.4 kg | Quadafoam MA |
| 0.4 kg | H-100 |
| 0.030 kg | Acid Yellow 219 |
| 0.018 kg | Acid Red 337 |
| 0.42 kg | Acid Blue 40 |

The above ingredients are mixed together with sufficient tap water to room temperature to make a 2,000 lb. mixture having a pH of 3 and a viscosity of 600 CPS.

| Color 4, Applicator 56 | |
|---|---|
| 0.68 kg | Acetic Acid |
| 6.0 kg | Syngum D47D |
| 0.3 kg | Quadafoam MA |
| 0.6 kg | H-100 |
| 0.27 kg | Acid Yellow 219 |
| 7.20 kg | Acid Red 337 |
| 3.96 kg | Acid Blue 40 |

The above ingredients are mixed together with sufficient tap water at room temperature to make a 6,000 lb. mixture having a pH of 5 and a viscosity of 30 CPS.

EXAMPLE 2

The material is the same as in Example 1.

| Color 1, Pad Machine 14 | |
|---|---|
| 0.45 kg | Acid Blue 40 |
| 1.125 kg | Acid Red 337 |
| 3.75 kg | Acid Yellow 219 |

The remaining ingredients are the same as in Example 1.

The above ingredients are mixed together to make a 5,000 lb. mixture having a pH of 4 and a viscosity of 50 CPS. Pad pressure and percent pickup are the same as in Example 1.

| Color 2, Applicator 32 | |
|---|---|
| 9.0 kg | Acid Yellow 219 |
| 0.36 kg | Acid Red 337 |
| 27.6 kg | Syngum D47D |
| 2.72 kg | Quadafoam MA |
| 8.16 kg | Formic Acid |
| 2.72 kg | DXN - preservative, Dimethoxano |
| 0.41 kg | Acetic Acid |

The above ingredients are mixed together with sufficient tap water at room temperature to provide a 6,000 lb. mixture having a viscosity of 1,800 CPS and a pH of 3.

| Color 3, Applicator 44 | |
|---|---|
| 1.32 kg | Acid Yellow 24 |
| 0.18 kg | Acid Red 337 |
| None | Acid Blue 40 |

The remaining ingredients pH and viscosity are the same as in Example 1.

| Color 4, Applicator 56 | |
|---|---|
| 9 kg | Acid Red 337 |
| 5.4 kg | Acid Blue 40 |

The remaining ingredients are the same as in Example 1. The above ingredients are mixed with sufficient tap water at room temperature to make a 6,000 lb. mixture having a viscosity of 30 CPS and a pH of 5.

In all of the above examples, the pH may be set to the desired value by adjusting the amount of acid added to amounts different than in the examples due to variations in pH in the water and the other elements added.

Nylon carpet dyed in the manner explained in the examples above exhibit what visually appears as a two-tone affect. The pile height described previously permits this affect and therefore any textile that has sufficient pile height to achieve that affect can be used with this process.

The pad machine 14, color 1, and color 3, applicator 44 are preferably a light shade of a given color, say a light rust color. The color 2 in applicator 32 is made a deep shade of that given color, say a deep rust. The color 4 is made a contrasting color, say a dark brown. Colors 1, 2 and 3 appear as different shadings of rust on most tuft tips. Color 4 appears as a contrasting second color at the base of most tufts. A two-tone affect with what appears as highlights on the surface is provided by the present process. Other effects may also be provided by varying the depth or strength of color of the different dyes.

It is to be understood that particular compositions or numbers of dyes used in the two examples above are not critical to the invention. While the dyes formulated in the above were made with a water base, it would be equally apparent that dyes with other bases having a different viscosity could also yield similar effects.

What is claimed is:

1. A tufted nylon textile material dyeing process comprising:

applying a sheet of a first aqueous acid dye solution at a first viscosity in the range of 600 to 5000 CPS to a surface of said textile material;

applying a second aqueous acid dye solution at a second viscosity in the range of $\frac{1}{3}$ to $\frac{2}{3}$ the viscosity of the first dye solution to a first portion of said surface;

applying a third aqueous acid dye solution at a third viscosity in the range of about 1/10 or less the second viscosity to a second portion of the textile material greater in area than and including said first portion, said first and second dye solutions effectively masking the textile material coated therewith from said third dye solution; and fixing the dyes of said dye solutions to said textile material.

2. The process of claim 1 further including the step of saturating said textile material with a fourth aqueous acid dye solution at a fourth viscosity of about 50 CPS prior to applying said sheet of said first dye solution.

3. The process of claim 1 wherein said process further including the step of vibrating said material to stand said tufts up prior to applying said sheet of first dye solution.

4. The process of claim 1 wherein said first dye solution has a pH of about 3 and a viscosity of about 1,800 CPS, said second dye solution has a pH of about 3 and a viscosity of about 600 CPS, and said third dye solution has a pH of about 5 and a viscosity of about 50 CPS.

5. The process of claim 1 further including the steps of dipping the textile material in a bath of a fourth aqueous acid dye solution at a fourth viscosity of about 50 CPS, squeezing the dipped textile material, and then vibrating the textile material to orient the yarns prior to applying said sheet of said first dye solution.

6. The process of claim 5 wherein said fourth dye solution is squeezed to a wet-pick-up in the range of 100–200 percent and has a viscosity about the same as the viscosity of said third dye solution, the first dye solution having a viscosity greater than the second dye solution.

7. The process of claim 6 wherein said fourth dye solution has a pH of about 4, said third dye solution has a pH of about 5, and said first and second dye solutions each have a pH of about 3.

8. The process of claim 5 wherein said first dye solution has a viscosity about 3 times as great as said ssecond dye solution and about 36 times as great as said third and fourth dye solutions.

9. The process of claim 1 wherein said second dye solution is applied in drops and said third dye solution is applied as a sheet of film over the face of the textile material.

10. A process for dyeing a nylon carpet having a backing and tufts extending from the backing comprising:

applying a layer of a first aqueous acid dye solution over the tufted face of the carpet, said layer having a first viscosity in the range of 600–5000 CPS;

applying drops of a second aqueous acid dye solution randomly over the tufted face of the layer coated carpet, while still wet, said second dye solution having a second viscosity of about $\frac{1}{3}$ to 170 of the first viscosity;

applying a layer of third aqueous acid dye solution to said carpet face while wet with said previously applied layer and drops, said third dye solution having a viscosity of about 1/10 or less the second viscosity value so as to be substantially masked from those portions of the textile material coated with said previously applied layer and drops; and fixing the dyes of said solutions to said carpet.

11. The process of claim 10 further including the steps of saturating the carpet with an aqueous acid dye solution having a viscosity of about 50 CPS, squeezing solution of the latter dye solution from the carpet and back beating the carpet to stand the tufts up prior to said applying said layer of first dye solution.

12. A method of dyeing a nylon tufted carpet in a continuous process comprising the steps of:

dyeing a web of the carpet with a first aqueous acid dye solution having a viscosity of about 50 CPS;

passing the web through squeeze rollers to remove some of the dye solution from the carpet and to obtain a desred percent of liquid pickup retained in the carpet;

vibrating the carpet web after it has passed through the squeeze rollers to cause at least most of the tufts to stand up;

applying to the entire tufted surface of the carpet web, after it has been vibrated and while it is still wet, a layer of a second aqueous acid dye solution having a viscosity in the range of 600–5000 CPS;

applying to the second dye solution covered surface of the carpet web, while the carpet is still wet from the previously applied dyes, drops of a third aqueous acid dye solution having a viscosity of about $\frac{1}{3}$ to $\frac{2}{3}$ the value of the viscosity of the second dye solution;

then applying to the carpet web, over the entire tufted surface of the carpet, while the surface is still wet from the previously applied dyes, a fourth aqueous acid dye solution at a viscosity of about 1/10 or less than the third solution viscosity that said fourth dye substantially masks the portions of the tufts of the carpet where coated by either said second or said third dye; and then fixing the dyes of said dye solutions to the carpet.

13. A method of dyeing as set forth in claim 12, wherein the fixing of the dyes occurs while the carpet web is moving, initially with the tufted surface up and then with the tufted surface down.

14. A method of dyeing as set forth in claim 12, wherein the first dye solution is similar in color to the second dye solution but is of a lighter shade than the second dye solution.

15. A emthod of dyeing as set forth in claim 12, wherein the viscosity of the third dye solution less than half that of the second dye solution.

* * * * *